US011913333B2

(12) United States Patent
Al-Shahri et al.

(10) Patent No.: US 11,913,333 B2
(45) Date of Patent: Feb. 27, 2024

(54) DETERMINATION OF THREE-PHASE FLUID SATURATIONS FROM PRODUCTION AND PRESSURE MEASUREMENTS FROM A WELL

(71) Applicant: Saudi Arabian Oil Company, Dhahran (SA)

(72) Inventors: Ali Al-Shahri, Dhahran (SA); Anas Al Shuaibi, Dhahran (SA); Hasan Nooruddin, Dhahran (SA); Khaled Benzaoui, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 75 days.

(21) Appl. No.: 17/666,946

(22) Filed: Feb. 8, 2022

(65) Prior Publication Data

US 2023/0250721 A1 Aug. 10, 2023

(51) Int. Cl.
*E21B 47/06* (2012.01)
*E21B 49/08* (2006.01)

(52) U.S. Cl.
CPC ..... *E21B 49/0875* (2020.05); *E21B 47/06* (2013.01)

(58) Field of Classification Search
CPC ..... E21B 49/0875; E21B 49/087; E21B 47/06
See application file for complete search history.

(56) References Cited

U.S. PATENT DOCUMENTS

| | | | |
|---|---|---|---|
| 7,739,089 | B2 | 6/2010 | Gurpinar et al. |
| 8,789,587 | B2 | 7/2014 | Tubel et al. |
| 9,341,060 | B2 | 5/2016 | Banian et al. |
| 10,519,768 | B2 | 12/2019 | Altaheini |
| 10,648,291 | B2 | 5/2020 | Zhang et al. |
| 2013/0096896 | A1 | 4/2013 | Al-Shahri |
| 2013/0096897 | A1 | 4/2013 | Shahri |
| 2020/0032623 | A1 | 1/2020 | McClure |
| 2021/0277749 | A1 | 9/2021 | Alhuraifi et al. |
| 2021/0310345 | A1 | 10/2021 | Aqeel et al. |

OTHER PUBLICATIONS

Akinnikawe, Oyewande et al.; "Synthetic Well Log Generation Using Machine Learning Techniques" URTeC: 2877021, Unconventional Resources Technology Conference, Houston, TX, Jul. 23-25, 2018; pp. 1-16.

Bawazir, Mustafa et al.; "Real-Time Production Logs Surveillance: Automated Workflow Technology Allows Synthetic Sensing of Oilfield Downhole Production" SPE-196390-MS, SPE/IATMI Asia Pacific Oil & Gas Conf. & Exhibition, Bali, Oct. 29-31, 2019; pp. 1-13.

*Primary Examiner* — Catherine Loikith
(74) *Attorney, Agent, or Firm* — Bracewell LLP; Constance G. Rhebergen; Brian H. Tompkins

(57) ABSTRACT

The determination of subsurface three-phase saturation (that is, oil, water, and gas saturation) across perforations and open completions of production wells using production rates and pressure measurements. A process may use the surface production rates of oil, water, and gas and measured pressures to determine well fractional flows. The subsurface three-phase saturation may be determined using the cell fractional flows calculated from the well fractional flows. Computer-readable media and systems for determining subsurface three-phase saturation are also provided.

18 Claims, 7 Drawing Sheets

DETERMINATION OF THREE-PHASE FLUID SATURATIONS FROM PRODUCTION AND PRESSURE MEASUREMENTS FROM A WELL

BACKGROUND

Field of the Disclosure

The present disclosure generally relates to the production of hydrocarbons from subsurface reservoirs. More specifically, embodiments of the disclosure relate to determining three-phase fluid saturations from measurements made in or around the reservoir during its production life.

Description of the Related Art

In the oil and gas industries, the development of underground hydrocarbon reservoirs includes development and analysis such reservoirs. These underground hydrocarbon reservoirs are typically complex rock formations which contain both a petroleum fluid mixture and water. The reservoir fluid content usually exists in two or more fluid phases. The petroleum mixture in reservoir fluids is produced by wells drilled into and completed in these rock formations.

The presence and movement of fluids in the reservoir varies over the reservoir, and certain characteristics or measures made during production from existing wells in a reservoir, are valuable in the planning and development of the reservoir. However, obtaining accurate characteristics or measurements may be difficult, costly, and time-consuming.

SUMMARY

Embodiments of the disclosure include the determination of subsurface three-phase saturation (that is, oil, water, and gas saturation) across perforations and open completions of production wells using production rates and pressure measurements. Embodiments include the generation of three-phase synthetic flowmeters (also referred to as synthetic production logs or "SPL") across open completions and perforations) from which the subsurface three-phase saturation may be determined. Advantageously, the determinations described in the disclosure do not require a historical dataset or library of production logs from the production wells to determine an accurate subsurface three-phase saturation. Embodiments of the disclosure use data (for example, production rates and pressure measurements) directly from the production wells and do not require generate of a numerical model, history matching, or model calibration, thus reducing time and cost as compared to such approaches.

In one embodiment, a computer implemented method for determining three-phase saturation of a subsurface reservoir from data measurements of a well in the reservoir during production is provided. The method includes obtaining a surface production rate of oil, a surface production rate of water, and a surface production rate of gas from the well, obtaining a static bottomhole pressure at a datum depth in the well, and determining a productivity index for each of a plurality of perforation cells associated with the well. The method further includes setting an initial well fractional flow, such that the initial well fractional flow includes an initial well fractional flow of oil, an initial well fractional flow of gas, and an initial well fractional flow of water. The method also includes setting an initial bottomhole pressure for each of the plurality of perforated cells associated with the well, determining, using the well fractional flow, a cell fractional flow of oil, a cell fractional flow of gas, and a cell fractional flow of water for each of the plurality of perforated, and determining, using the static bottomhole pressure, a cell bubble point pressure for each of the plurality of perforated cells. The method further includes determining, using the cell bubble point pressure for each of the plurality of perforated cells, a pressure-volume-temperature (PVT) property for each of the plurality of perforated cells, determining, using the PVT property for each of the plurality of perforated cells, an oil density, a gas density, and a water density for each of the plurality of perforated cells, and determining, using the oil density, the gas density, and the water density for each of the plurality of perforated cells and the cell fractional flow of oil, the cell fractional flow of gas, and the cell fractional flow of water for each of the plurality of perforated cells, an average oil density, an average gas density, and an average water density for each of the plurality of perforated cells. Additionally, the method includes determining, using the PVT property for each of the plurality of perforated cells and the cell fractional flow of oil, the cell fractional flow of gas, and the cell fractional flow of water for each of the plurality of perforated cells, a PVT property for the well, and determining, using the PVT property for the well, a total production rate for the well at reservoir conditions, the total production rate including a total production rate of oil, a total production rate of gas, and a total production rate of water. The method also includes determining, using the total production rate and the PVT property for the well, a new well fractional flow of oil, a new well fractional flow of gas, and a new well fractional flow of water and using the new well fractional flow of oil, the new well fractional flow of gas, and the new well fractional flow of water, to determine the three-phase saturation of the subsurface reservoir, such that the three-phase saturation includes an oil saturation, a gas saturation, and a water saturation.

In some embodiments, the PVT property for each of the plurality of perforated cells includes a cell oil formation volume factor, a cell gas formation volume factor, a cell water formation volume factor, and a cell solution gas-oil ratio. In some embodiments, the PVT property for the well includes a well oil formation volume factor, a well gas formation volume factor, a well water formation volume factor, and a well solution gas-oil ratio. In some embodiments, the method includes comparing the new well fractional flow of oil to the initial well fractional of oil to determine an oil error value, comparing the oil error value to a first threshold, comparing the new well fractional flow of gas to the initial well fractional of gas to determine a gas error value, comparing the gas error value to a second threshold, comparing the new well fractional flow of water to the initial well fractional of water to determine a water error value, and comparing the water error value to a third threshold. In some embodiments, the method includes determining a new static bottomhole pressure for each of the plurality of perforated cells using the average oil density, the average gas density, and the average water density for each of the plurality of perforated cells. In some embodiments, the method includes comparing the new static bottomhole pressure for each of the plurality of perforated cells to the initial bottomhole pressure for each of a plurality of perforation cells to determine a pressure value and comparing the pressure error value to a third threshold. In some embodiments, the method includes identifying a drilling site using the three-phase saturation. In some embodiments, the method includes drilling a well based on the identification.

In another embodiment, a non-transitory computer-readable storage medium having executable code stored thereon for determining three-phase saturation of a subsurface reservoir from data measurements of a well in the reservoir during production is provided. The executable code includes a set of instructions that causes a processor to perform operations that include obtaining a surface production rate of oil, a surface production rate of water, and a surface production rate of gas from the well, obtaining a static bottomhole pressure at a datum depth in the well, and determining a productivity index for each of a plurality of perforation cells associated with the well. The operations further include setting an initial well fractional flow, such that the initial well fractional flow includes an initial well fractional flow of oil, an initial well fractional flow of gas, and an initial well fractional flow of water. The operations also include setting an initial bottomhole pressure for each of the plurality of perforated cells associated with the well, determining, using the well fractional flow, a cell fractional flow of oil, a cell fractional flow of gas, and a cell fractional flow of water for each of the plurality of perforated, and determining, using the static bottomhole pressure, a cell bubble point pressure for each of the plurality of perforated cells. The operations further include determining, using the cell bubble point pressure for each of the plurality of perforated cells, a pressure-volume-temperature (PVT) property for each of the plurality of perforated cells, determining, using the PVT property for each of the plurality of perforated cells, an oil density, a gas density, and a water density for each of the plurality of perforated cells, and determining, using the oil density, the gas density, and the water density for each of the plurality of perforated cells and the cell fractional flow of oil, the cell fractional flow of gas, and the cell fractional flow of water for each of the plurality of perforated cells, an average oil density, an average gas density, and an average water density for each of the plurality of perforated cells. Additionally, the operations include determining, using the PVT property for each of the plurality of perforated cells and the cell fractional flow of oil, the cell fractional flow of gas, and the cell fractional flow of water for each of the plurality of perforated cells, a PVT property for the well, and determining, using the PVT property for the well, a total production rate for the well at reservoir conditions, the total production rate including a total production rate of oil, a total production rate of gas, and a total production rate of water. The operations also include determining, using the total production rate and the PVT property for the well, a new well fractional flow of oil, a new well fractional flow of gas, and a new well fractional flow of water and using the new well fractional flow of oil, the new well fractional flow of gas, and the new well fractional flow of water, to determine the three-phase saturation of the subsurface reservoir, such that the three-phase saturation includes an oil saturation, a gas saturation, and a water saturation.

In some embodiments, the PVT property for each of the plurality of perforated cells includes a cell oil formation volume factor, a cell gas formation volume factor, a cell water formation volume factor, and a cell solution gas-oil ratio. In some embodiments, the PVT property for the well includes a well oil formation volume factor, a well gas formation volume factor, a well water formation volume factor, and a well solution gas-oil ratio. In some embodiments, the operations include comparing the new well fractional flow of oil to the initial well fractional of oil to determine an oil error value, comparing the oil error value to a first threshold, comparing the new well fractional flow of gas to the initial well fractional of gas to determine a gas error value, comparing the gas error value to a second threshold, comparing the new well fractional flow of water to the initial well fractional of water to determine a water error value, and comparing the water error value to a third threshold. In some embodiments, the operations include determining a new static bottomhole pressure for each of the plurality of perforated cells using the average oil density, the average gas density, and the average water density for each of the plurality of perforated cells. In some embodiments, the operations include comparing the new static bottomhole pressure for each of the plurality of perforated cells to the initial bottomhole pressure for each of a plurality of perforation cells to determine a pressure value and comparing the pressure error value to a third threshold. In some embodiments, the operations include identifying a drilling site using the three-phase saturation.

In another embodiment, a system for determining three-phase saturation of a subsurface reservoir from data measurements of a well in the reservoir during production is provided. The system includes a processor and a non-transitory computer-readable memory accessible by the processor and having executable code stored thereon. The executable code includes a set of instructions that causes a processor to perform operations that include obtaining a surface production rate of oil, a surface production rate of water, and a surface production rate of gas from the well, obtaining a static bottomhole pressure at a datum depth in the well, and determining a productivity index for each of a plurality of perforation cells associated with the well. The operations further include setting an initial well fractional flow, such that the initial well fractional flow includes an initial well fractional flow of oil, an initial well fractional flow of gas, and an initial well fractional flow of water. The operations also include setting an initial bottomhole pressure for each of the plurality of perforated cells associated with the well, determining, using the well fractional flow, a cell fractional flow of oil, a cell fractional flow of gas, and a cell fractional flow of water for each of the plurality of perforated, and determining, using the static bottomhole pressure, a cell bubble point pressure for each of the plurality of perforated cells. The operations further include determining, using the cell bubble point pressure for each of the plurality of perforated cells, a pressure-volume-temperature (PVT) property for each of the plurality of perforated cells, determining, using the PVT property for each of the plurality of perforated cells, an oil density, a gas density, and a water density for each of the plurality of perforated cells, and determining, using the oil density, the gas density, and the water density for each of the plurality of perforated cells and the cell fractional flow of oil, the cell fractional flow of gas, and the cell fractional flow of water for each of the plurality of perforated cells, an average oil density, an average gas density, and an average water density for each of the plurality of perforated cells. Additionally, the operations include determining, using the PVT property for each of the plurality of perforated cells and the cell fractional flow of oil, the cell fractional flow of gas, and the cell fractional flow of water for each of the plurality of perforated cells, a PVT property for the well, and determining, using the PVT property for the well, a total production rate for the well at reservoir conditions, the total production rate including a total production rate of oil, a total production rate of gas, and a total production rate of water. The operations also include determining, using the total production rate and the PVT property for the well, a new well fractional flow of oil, a new well fractional flow of gas, and a new well fractional flow of water and using the new well fractional flow of oil, the new well fractional flow of gas, and the new well fractional flow of water, to determine the three-phase saturation of the subsurface reservoir, such that the three-phase saturation includes an oil saturation, a gas saturation, and a water saturation.

In some embodiments, the PVT property for each of the plurality of perforated cells includes a cell oil formation volume factor, a cell gas formation volume factor, a cell water formation volume factor, and a cell solution gas-oil ratio. In some embodiments, the PVT property for the well includes a well oil formation volume factor, a well gas formation volume factor, a well water formation volume factor, and a well solution gas-oil ratio. In some embodiments, the operations include comparing the new well fractional flow of oil to the initial well fractional of oil to determine an oil error value, comparing the oil error value to a first threshold, comparing the new well fractional flow of gas to the initial well fractional of gas to determine a gas error value, comparing the gas error value to a second threshold, comparing the new well fractional flow of water to the initial well fractional of water to determine a water error value, and comparing the water error value to a third threshold. In some embodiments, the operations include determining a new static bottomhole pressure for each of the plurality of perforated cells using the average oil density, the average gas density, and the average water density for each of the plurality of perforated cells. In some embodiments, the operations include comparing the new static bottomhole pressure for each of the plurality of perforated cells to the initial bottomhole pressure for each of a plurality of perforation cells to determine a pressure value and comparing the pressure error value to a third threshold. In some embodiments, the operations include identifying a drilling site using the three-phase saturation.

DETAILED DESCRIPTION

The present disclosure will be described more fully with reference to the accompanying drawings, which illustrate embodiments of the disclosure. This disclosure may, however, be embodied in many different forms and should not be construed as limited to the illustrated embodiments. Rather, these embodiments are provided so that this disclosure will be thorough and complete, and will fully convey the scope of the disclosure to those skilled in the art.

Embodiments of the disclosure include processes and systems for determining three-phase saturation (that is, oil, water, and gas saturation) in production wells using production rates (that is, production rates of oil, water, and gas) and pressure measurements. The production wells may include perforations and open completions of production wells. Embodiments further include identifying new drilling sites, such as potential dry oil regions or for infill drilling, using the three-phase saturation. For example, in some embodiments the three-phase saturation may be provided to a 4D saturation model for further analysis of a hydrocarbon reservoir.

Figure 1:
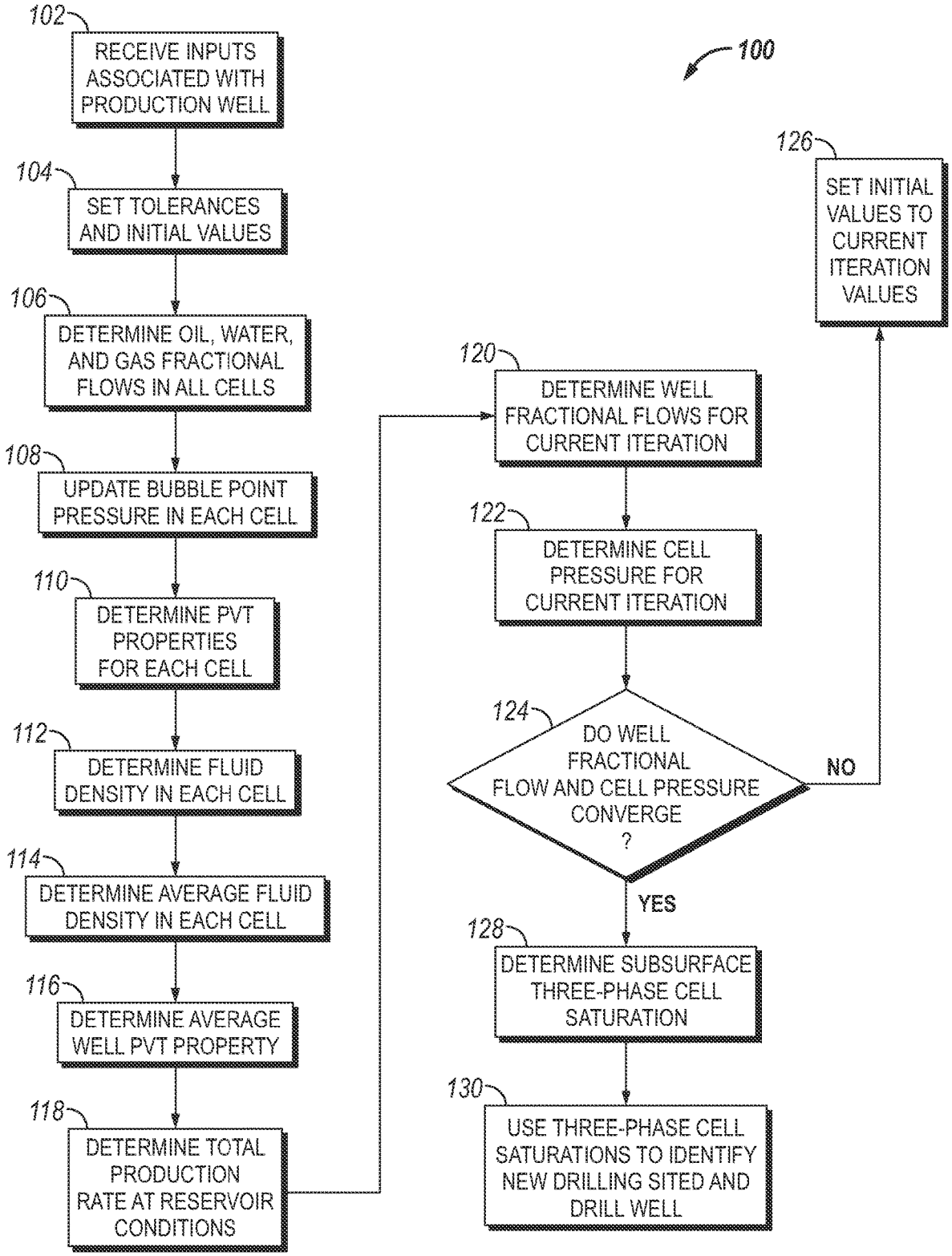
FIG. 1 is flowchart of a process for determining subsurface three-phase saturation (that is, oil, water, and gas saturation) in production wells in accordance with an embodiment of the disclosure.

FIG. 1 depicts a process 100 for determining subsurface three-phase saturation (that is, oil, water, and gas saturation) in production wells in accordance with an embodiment of the disclosure. As described herein, the process 100 may use determinations derived from fluid flow determinations governing flow in porous media. Flow contribution may be calculated in each open perforation using Darcy's equation, thus allowing flow contribution to depend on cell geometry, completion direction, pressure-volume-temperature (PVT), relative permeability, RF factor, skin, wellbore radius, and equivalent drainage radius.

The process may include receiving inputs associated with the production well (block 102). Next, tolerances and initial values may be set (block 104). As shown in FIG. 1, oil, water, and gas fractional flows in all cells may be determined (block 106). The bubble point pressure in all cells may then be updated (block 108). The pressure-volume-temperature (PVT) properties in all cells may be determined (block 110). Next, the fluid density in all cells may be determined (block 112). After determination of the fluid density, the average fluid density in all cells may be determined (block 114).

As shown in FIG. 1, the average well PVT properties may then be determined (block 116). Next, the total production rate at reservoir conditions is determined (block 118). The well fractional flows for the current iteration are determined (block 120). Additionally, the cell pressure at the new iteration is determined (block 122).

In some embodiments, the convergence of certain values such as well fractional flows and cell pressure may be identified (decision block 124) to determine if the process is complete or if additional iterations are performed. If additional iterations are performed, the initial values may be set to the well fractional flows and cell pressure for the current iteration (block 126) and the process performs another iteration beginning with the determination of oil, water, and gas fractional flows in all cells (block 106).

If the well fractional flows and cell pressure converge (decision block 124), the subsurface three-phase cell saturation may be determined from the well fractional flows (block 128). In some embodiments, the subsurface three-phase saturation may be used to identify new drilling sites and drill a well (block 130). Each of the following steps of the process 100 are discussed in detail infra.

As shown in FIG. 1, inputs associated with one or more production wells may be determined (block 102). The inputs may include 1) surface production rates for oil, water, and gas from the production well; 2) the measured static bottomhole pressure corrected at datum depth (also referred to as "depth datum"); 3) pressure, volume, and temperature (PVT) properties for the produced oil, water and gas; 4) bubble point pressure vs. depth; and 5) cell productivity index (PI) and depths (referred to well completions data). The subsurface production rates may be obtained from production logs, and static bottomhole pressure may be determined using techniques known in the art. The pressure, volume, and temperature (PVT) properties for the produced oil, water and gas and the initial bubble point pressure vs. depth may be measured and determined using techniques known in the art. In some embodiments subsurface production rates, bottomhole pressure, and other data may be obtained using continuous data measurement devices (also referred to as "permanent downhole gauges" or as a part of "permanent downhole monitoring systems").

The cell's production index (PI) may be determined according to the techniques describe supra. The determination is based on the assumption that the total production rate of a well is equivalent to the summation of the individual contribution from each perforated grid-block, as shown in Equation 1:

$$WQ_t=\Sigma_{i=1}^{n}CQ_{t_i} \tag{1}$$

where WQt is the total production rate of a given well at reservoir conditions in units of barrels/day (bbl/d), subscript t refers to the total fluid production, which may be decomposed further into individual phases of oil, water and gas, $CQ_{t_i}$ is the total fluid production rate of a given perforated cell with index i at reservoir conditions in units of bbl/d (the term cell may also refer to or include other terms used interchangeable in the art, such as grid-block or connection), and n is the total number of perforated cells in a given well.

Using Darcy's law, $CQ_{t_i}$ maybe determined according to Equation 2:

$$CQ_{t_i}=CPI_i(CP_i-P_{wf}) \tag{2}$$

where $CPI_i$ is the productivity index in cell i in barrels/day/pound per square inch (bbl/d/psia), $CP_i$ is the pressure of cell i in pounds per square inch absolute (psia), and $P_{wf}$ is the following wellbore pressure in psia. The productivity index (PI) in a perforated cell in reservoir simulation models may be determined according to Equation 3:

$$PI_i=\frac{1.127*10^{-3}k_ih_i\lambda_{t_i}RF_i}{\ln\left(\frac{r_{e_i}}{r_{w_i}}\right)+s_i} \tag{3}$$

where $PI_i$ is the productivity index, $k_i$ is the average cell permeability in millidarcy (mD), $h_i$ is the cell thickness in feet (ft), $\lambda_{ti}$ is the total mobility in units of 1/centipoise (cp−1), $RF_i$ is a dimensionless quantity that reflects how much of the open perforations are penetrating the cell, $r_{ei}$ is the equivalent radius in feet (ft), $r_{wi}$ is the wellbore radius in ft, and $s_i$ is the skin factor in dimensionless quantity.

The total mobility ($\lambda_{ti}$) may be determined according to Equation 4:

$$\lambda_{t_i}=\lambda_{o_i}+\lambda_{w_i}+\lambda_{g_i} \tag{4}$$

where $\lambda_{oi}$ is the oil mobility, $\lambda_{wi}$ is the water mobility, and $\lambda_{gi}$ is the gas mobility.

The equivalent radius ($r_{ei}$) may be determined using known techniques. In some embodiments, the equivalent radius is determined using Peaceman's well model based on cell geometry and permeability anisotropy.

Figure 2:
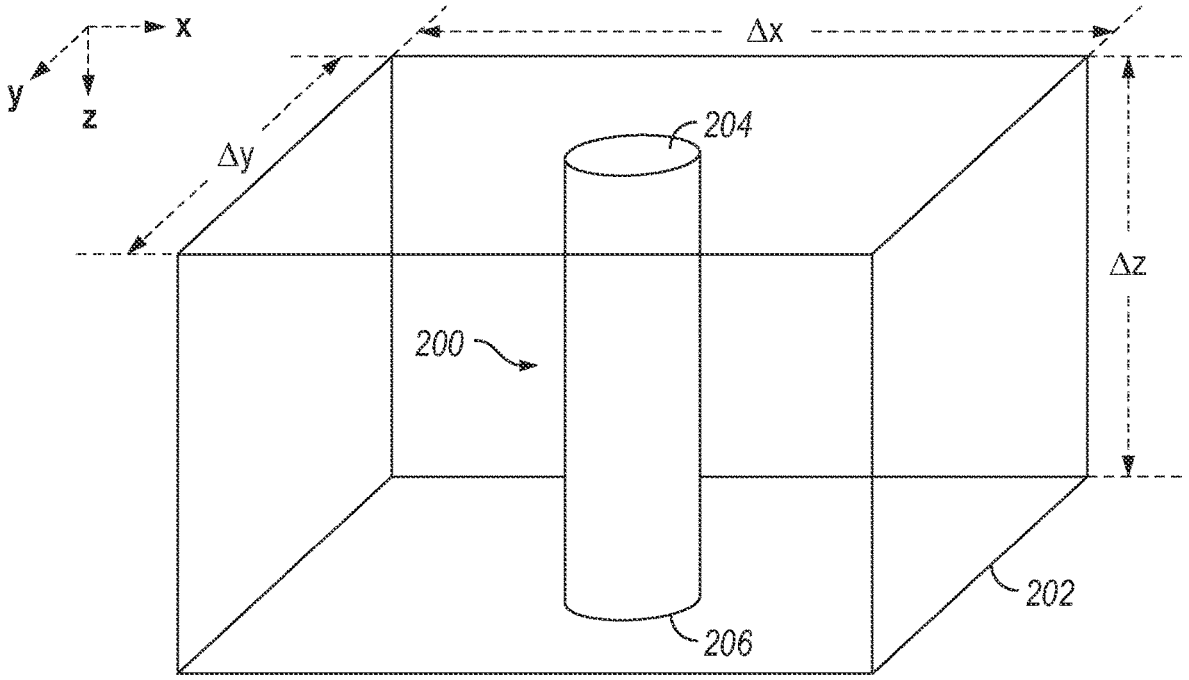
FIG. 2 is a schematic representation of a portion of a well completed in the z-direction inside a perforated cell in accordance with an embodiment of the disclosure.
Figure 3:
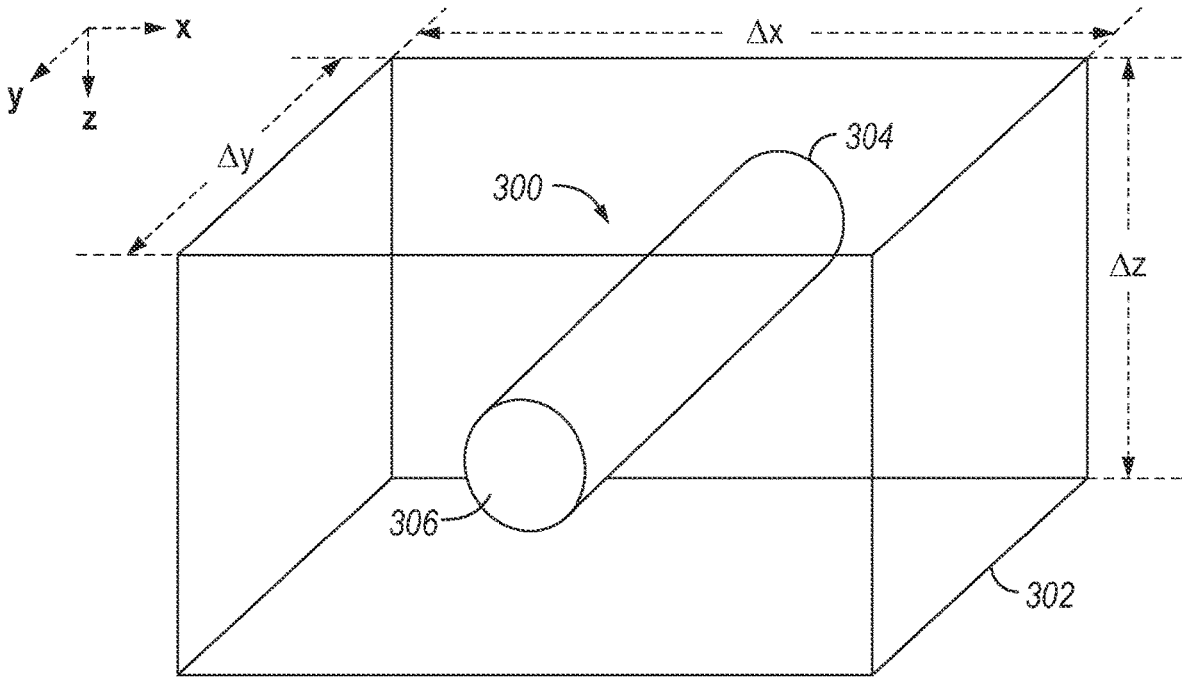
FIG. 3 is a schematic representation of a portion of a well completed in the y-direction inside a perforated cell in accordance with an embodiment of the disclosure.
Figure 4:
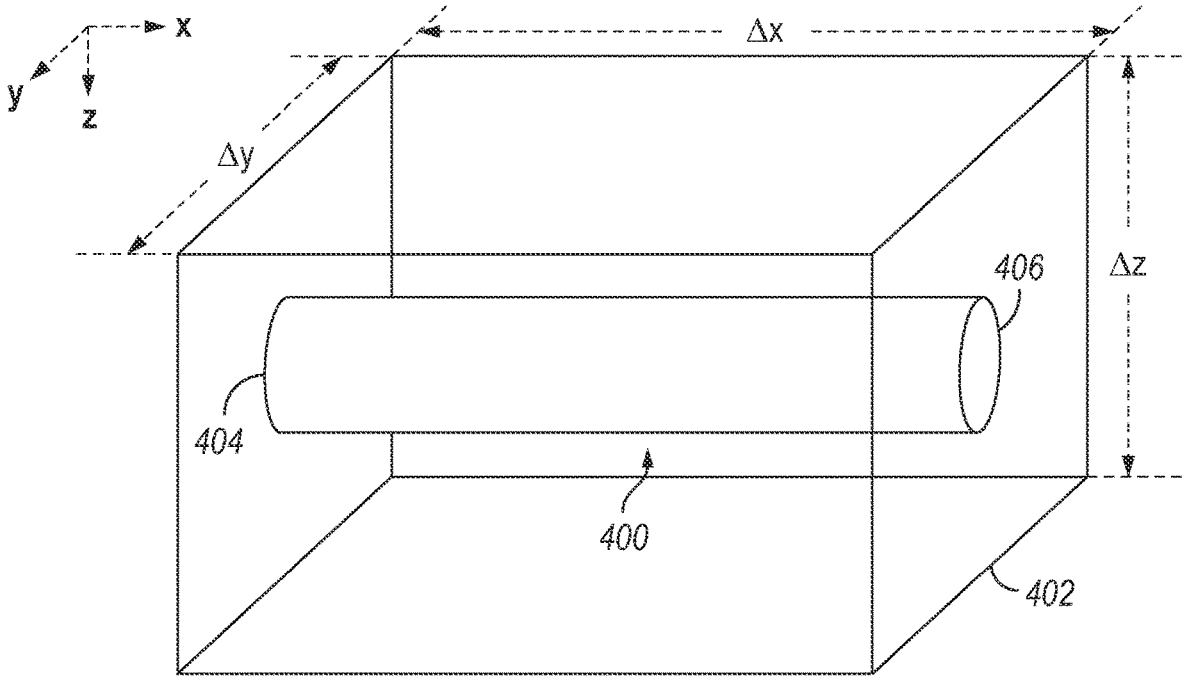
FIG. 4 is a schematic representation of a portion of a well completed in the x-direction inside a perforated cell in accordance with an embodiment of the disclosure.

In some embodiments, the productivity index (PI) may be adjusted based on the direction of the well (that is, vertical or horizontal) and the direction of completion (that is, in the z-, x-, or y-direction). FIGS. 2, 3, and 4 are schematic depictions these various completions and the associated adjustments are discussed infra.

FIG. 2 is a schematic representation of a portion 200 of a well completed in the z-direction inside a perforated cell 202 in accordance with an embodiment of the disclosure. As shown in FIG. 2, the portion 200 is defined according to the measured depth of the well at which it enters the cell ($M_{in}$) 204 and the measured depth of the well at which it exits the cell out ($MD_{out}$) 206. The cell 202 may be defined according to the respective dimensions in the x-, y-, and z-directions: Δx, Δy, and Δz.

The determination of the parameters $k_i$ (average cell permeability), $h_i$ (cell thickness) $RF_i$ (how much of the open perforations are penetrating the cell) and $r_{ei}$ (equivalent radius) depend on the direction of the completion. In the z-direction, ki may be determined according to Equation 5:

$$k_i=\sqrt{k_{x_i}k_{y_i}} \tag{5}$$

Where $k_{xi}$ is the average cell permeability in the x-direction and $k_{yi}$ is the average cell permeability in the y-direction. Hi may be determined according to Equation 6:

$$h_i=\Delta z_i \tag{6}$$

$RF_i$ may be determined according to Equation 7:

$$RF_i=\frac{(MD_{out})_i-(MD_{in})_i}{\Delta z_i} \tag{7}$$

The equivalent radius $r_{ei}$ may be determined according to Equation 8:

$$r_{e_i}=0.28\frac{\left((\Delta x_i)^2\sqrt{\frac{k_{y_i}}{k_{x_i}}}+(\Delta y_i)^2\sqrt{\frac{k_{x_i}}{k_{y_i}}}\right)^{\frac{1}{2}}}{\sqrt[4]{\frac{k_{y_i}}{k_{x_i}}}+\sqrt[4]{\frac{k_{x_i}}{k_{y_i}}}} \tag{8}$$

FIG. 3 is a schematic representation of a portion 300 of a well completed in the y-direction inside a perforated cell 302 in accordance with an embodiment of the disclosure. As shown in FIG. 3, the portion 300 is defined according to the measured depth in (MD in) 304 and the measured depth (MD) out (MD out) 306. The cell 302 may be defined according to the respective dimensions in the x-, y-, and z-directions: Δx, Δy, and Δz. In the y-direction, ki may be determined according to Equation 9:

$$k_i=\sqrt{k_{x_i}k_{z_i}} \tag{9}$$

Where $k_{zi}$ is the average cell permeability in the z-direction. $h_i$ may be determined according to Equation 10:

$$h_i=\Delta y_i \tag{10}$$

$RF_i$ may be determined according to Equation 11:

$$RF_i = \frac{(MD_{out})_i - (MD_{in})_i}{\Delta y_i} \tag{11}$$

The equivalent radius re, may be determined according to Equation 12:

$$r_{e_i} = 0.28\frac{\left((\Delta x_i)^2\sqrt{\frac{k_{z_i}}{k_{x_i}}} + (\Delta z_i)^2\sqrt{\frac{k_{x_i}}{k_{z_i}}}\right)^{\frac{1}{2}}}{\sqrt[4]{\frac{k_{z_i}}{k_{x_i}}} + \sqrt[4]{\frac{k_{x_i}}{k_{z_i}}}} \tag{12}$$

FIG. 4 is a schematic representation of a portion 400 of a well completed in the x-direction inside a perforated cell 402 in accordance with an embodiment of the disclosure. As shown in FIG. 2, the portion 400 is defined according to the measured depth in (MD in) 404 and the measured depth (MD) out (MD out) 406. The cell 402 may be defined according to the respective dimensions in the x-, y-, and z-directions: Δx, Δy, and Δz. In the x-direction, ki may be determined according to Equation 13:

$$k_i = \sqrt{k_{y_i} k_{z_i}} \tag{13}$$

$h_i$ may be determined according to Equation 14:

$$h_i = \Delta x_i \tag{14}$$

$RF_i$ may be determined according to Equation 15:

$$RF_i = \frac{(MD_{out})_i - (MD_{in})_i}{\Delta x_i} \tag{15}$$

The equivalent radius $r_{ei}$ may be determined according to Equation 16:

$$r_{e_i} = 0.28\frac{\left((\Delta y_i)^2\sqrt{\frac{k_{z_i}}{k_{y_i}}} + (\Delta z_i)^2\sqrt{\frac{k_{y_i}}{k_{z_i}}}\right)^{\frac{1}{2}}}{\sqrt[4]{\frac{k_{z_i}}{k_{y_i}}} + \sqrt[4]{\frac{k_{y_i}}{k_{z_i}}}} \tag{16}$$

(14)

As shown in FIG. 1, tolerances and initial values may be set (block 104). In certain embodiments, the pressure tolerance and well fractional flow tolerance may be set. The cell pressure tolerance ($CP_{tol}$) may be set at the cell-level, as static bottomhole pressure may be calculated in each cell and used for the determinations of oil, gas, and water PVT properties. The well fractional flow tolerance ($WF_{tol}$) may be set at the well-level and may be used to stop iterating the process 100 on the well-level fractional flow for oil, water, and gas. For example, in some embodiments of the process 100, $CP_{tol}$=1 pounds per square inch absolute (psia) and $WF_{tol}$=0.001.

Additionally, the average well-level fractional flow for oil $(WF_o)^n$, water $(WF_w)^n$, and gas $(WF_g)^n$ may be set to initial values to satisfy the following conditions of Equation 17:

$$(WF_o)^n + (WF_w)^n + (WF_g)^n = 1 \tag{17}$$

For example, in some embodiments, the initial values may be: $(WF_o)^n$=0.34, $(WF_w)^n$=0.33, and $(WF_g)^n$=0.33.

The initial static bottomhole pressure $(CP)^n$ for all perforated cells may be set (that is, all cells may receive the same value). In some embodiments, this value may be the measured static bottomhole pressure corrected to datum depth. For example, in some embodiments, $(CP)^n$=2500 psia. The initial bubble-point pressure $(CP_b)^n$ for or all perforated cells may be set using the bubble point pressure vs depth data.

An iteration of the process 100 may start with the determination of the fractional flows for oil $(CF_o)^n$, water $(CF_w)^n$, and gas $(CF_g)^n$ using the initial average well fractional flow values (block 106). As will be appreciated, two physical processes or combination thereof may occur that dominate the displacement process in the subsurface: gravity-dominated or viscous dominated. In gravity-dominated flows, water slumps down to the base of the reservoir while gas rises up. This phenomena results in water encroaching the most bottom perforated cells, while gas encroaches the most top perforated cells. The key factor in this process is the cell depth CZ. In viscous-dominated flow, water and gas invade cells differently depending on the speed of the flood front in the cells. The key factor here is the fluid interstitial velocity $v_i$. The fluid interstitial velocity may be determined according to Equation 18:

$$v_i \equiv \frac{Qt_i}{A_i \phi_i} \tag{18}$$

Where $A_i$ is the cross-sectional area open to flow, and $\phi_i$ is the porosity of the cell i. This expression is derived from fractional-flow theory, and may be used to rank cells such that cells with a greater speed will be encroached first. The well fractional flow (WF) may be related to cell fractional flow (CF) using the following equations:

$$WQ_t = CQ_{t_1} + CQ_{t_2} + \ldots + CQ_{t_n} \tag{19}$$

$$WQ_o = CQ_{o_1} + CQ_{o_2} + \ldots + CQ_{o_n} \tag{20}$$

$$WQ_g = CQ_{g_1} + CQ_{g_2} + \ldots + CQ_{g_n} \tag{21}$$

$$WQ_w = CQ_{w_1} + CQ_{w_2} + \ldots + CQ_{w_n} \tag{22}$$

where $WQ_t$ is the total production rate of the well in bbl/d, $CQ_{t_i}$ is the total production rate of cell i in bbl/d, $WQ_o$ is the oil production rate of the well in bbl/d, $CQ_{i_i}$ is the oil production rate of cell i in bbl/d, $WQ_g$ is the gas production rate of the well in bbl/d, $CQ_{g_i}$ is the gas production rate of cell i in bbl/d, $WQ_w$ is the water production rate of the well in bbl/d, $CQ_{w_i}$ is the water production rate of cell i in bbl/d, and the subscript n is the total number of cells.

The following equations may be derived from Equations 20-22 by diving by $WQ_t$:

$$\frac{WQ_o}{WQ_t} = \frac{CQ_o}{CQ_{t_1}}\frac{CQ_{t_1}}{WQ_t} + \frac{CQ_{o_2}}{CQ_{t_n}}\frac{CQ_{t_2}}{WQ_t} + \ldots + \frac{CQ_{o_n}}{CQ_{t_n}}\frac{CQ_{t_n}}{WQ_t} \tag{23}$$

$$\frac{WQ_w}{WQ_t} = \frac{CQ_{w_1}}{CQ_{t_1}}\frac{CQ_{t_1}}{WQ_t} + \frac{CQ_{w_2}}{CQ_{t_n}}\frac{CQ_{t_2}}{WQ_t} + \ldots + \frac{CQ_{w_n}}{CQ_{t_n}}\frac{CQ_{t_n}}{WQ_t} \tag{24}$$

$$\frac{WQ_g}{WQ_t} = \frac{CQ_{g_1}}{CQ_{t_1}}\frac{CQ_{t_1}}{WQ_t} + \frac{CQ_{g_2}}{CQ_{t_n}}\frac{CQ_{t_2}}{WQ_t} + \ldots + \frac{CQ_{g_n}}{CQ_{t_n}}\frac{CQ_{t_n}}{WQ_t} \tag{25}$$

The known relationships between $WQ_t$, $WQ_o$, $WQ_w$, and $WQ_g$ used to derive Equations 23-25 are:

$$WF_o = \frac{WQ_o}{WQ_t} \tag{26}$$

$$WF_w = \frac{WQ_w}{WQ_t} \tag{27}$$

$$WF_g = \frac{WQ_g}{WQ_t} \tag{28}$$

The known relationships between $CQ_t$, $CQ_o$, $CQ_w$, and $CQ_g$ used to derive Equations 23-25 are:

$$CF_o = \frac{CQ_o}{CQ_t} \tag{29}$$

$$CF_w = \frac{CQ_w}{CQ_t} \tag{30}$$

$$CF_g = \frac{CQ_g}{CQ_t} \tag{31}$$

A weighting factor $w_i$ may be used that represents the fractional contribution of fluids form cell i compared to the overall production of a well. The weighting factor $w_i$ may be determined using the assumption that the pressure differential $\Delta p$ does not vary greatly between perforated cells. The assumption is valid for most operating conditions as huge variations in open perforations in a well is exceedingly rare. Under this assumption, the weighting factor $w_i$ may be determined according to the following:

$$w_i \equiv \frac{CQ_{t_i}}{WQ_i} \approx \frac{PI_i\lambda_{t_i}}{\sum_{i=1}^{n} PI_i\lambda_{t_i}} \tag{32}$$

By combining the definitions in Equations 26-32 into Equations 23-25, the well fractional flow WF and cell fractional flow CF may be related as follows:

$$WF_o = w_1*(CF_o)_1 + w_2*(CF_o)_2 + \ldots + w_n*(CF_o)_n \tag{33}$$

$$WF_w = w_1*(CF_w)_1 + w_2*(CF_w)_2 + \ldots + w_n*(CF_w)_n \tag{34}$$

$$WF_w = w_1*(CF_w)_1 + w_2*(CF_w)_2 + \ldots + w_n*(CF_w)_n \tag{35}$$

The unknowns in Equations 33-34 are the cell fractional flows CF. In some embodiments, the determination of $(CF_w)^n$, $(CF_g)^n$ and $(CF_o)^n \forall i \in [1, n]$ may be according to the following approach that is suitable for both gravity- and viscous-dominated displacements. In this approach, cells are ordered based on their filling sequence, such that in Equations 33-35, cell 1 is filled first, followed by cell 2, and so on until cell n. Cells are filled up with water and gas in series until well-level fractional flow (WF) is reached. Under this approach, the following may be used to determine cell fractional flows:

$$\delta_i = \frac{WF - \sum_{n=1}^{i-1} w_n}{w_i} \tag{36}$$

$$CF_i = \begin{cases} 0, & \text{if } \delta_i < 0 \\ 1, & \text{if } \delta_i > 1 \\ \delta_i, & \text{if } 0 \le \delta_i \le 1 \end{cases} \tag{37}$$

Next, the bubble point pressure in each cell is updated (block 108). The cell bubble point pressure $(CP_b)_i^{n+1}$ is updated based on the initial or previous bubble-point pressure $(CP_b)_i^n$ and the static bottomhole pressure $(CP_i)$, according to the following:

$$(CP_b)_i^{n+1} = \begin{cases} (CP_b)_i^n, & \text{if } (CP_i) \ge (CP_b)_i^n \\ (CP_i), & \text{otherwise} \end{cases} \tag{38}$$

Equation 38 assumes that whenever static pressure drops below bubble-point pressure, gas percolates to the main gas cap and will never dissolve again in the oil even at higher reservoir pressures. The cell bubble point pressures may be used to evaluate fluid PVT properties. In embodiments in which the gas re-dissolves in the oil at greater pressures, the following may be used to determine the cell bubble point pressure:

$$(CP_b)_i^{n+1} = (CP_i) \tag{39}$$

Figure 5:
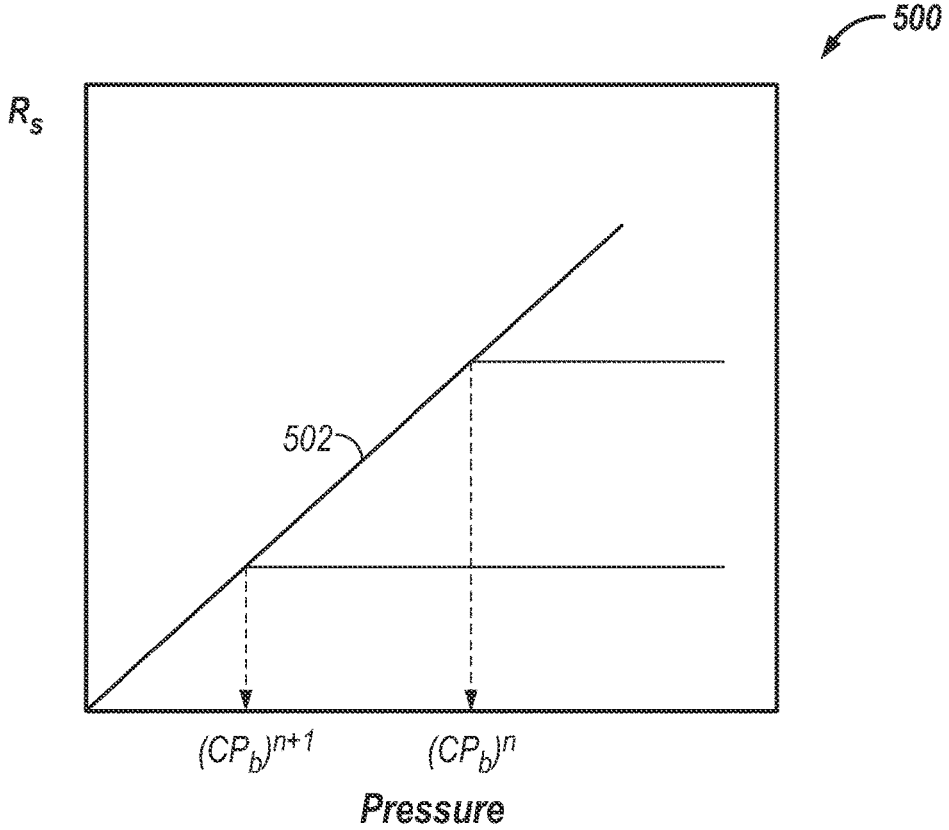
FIG. 5 is a graph of solution gas-oil ratio ($R_s$) vs cell pressure in accordance with an embodiment of the disclosure.

Next, PVT properties may be determined for each cell (block 110). These properties may include cell-level oil, water and gas formation volume factors ($CB_o$, $CB_g$ and $CB_w$) and gas solubility (also referred to as solution gas-oil ratio) ($CR_s$). FIGS. 5-8 depict the determination of these factors in accordance with embodiments of the disclosure. The determination may account for variable bubble point pressures and may extrapolate for accurate PVT curves at any pressure ranges. FIG. 5 is a graph 500 of solution gas-oil ratio ($R_s$) vs cell pressure in accordance with an embodiment of the disclosure. FIG. 5 also shows the interpolation of cell gas solubility ($CR_s$) as a function of cell bubble point pressure ($CP_b$) and cell pressure (CP). The saturation line 502 may be used to extrapolate for the correct $CR_s$ value as a function of CP at a given $CP_b$. Below the $CP_b$ value, $CR_s$ may be evaluated on the line 502. Above $CP_b$, $CR_s$ may be evaluated as a constant depending on the $CP_b$ value.

Figure 6:
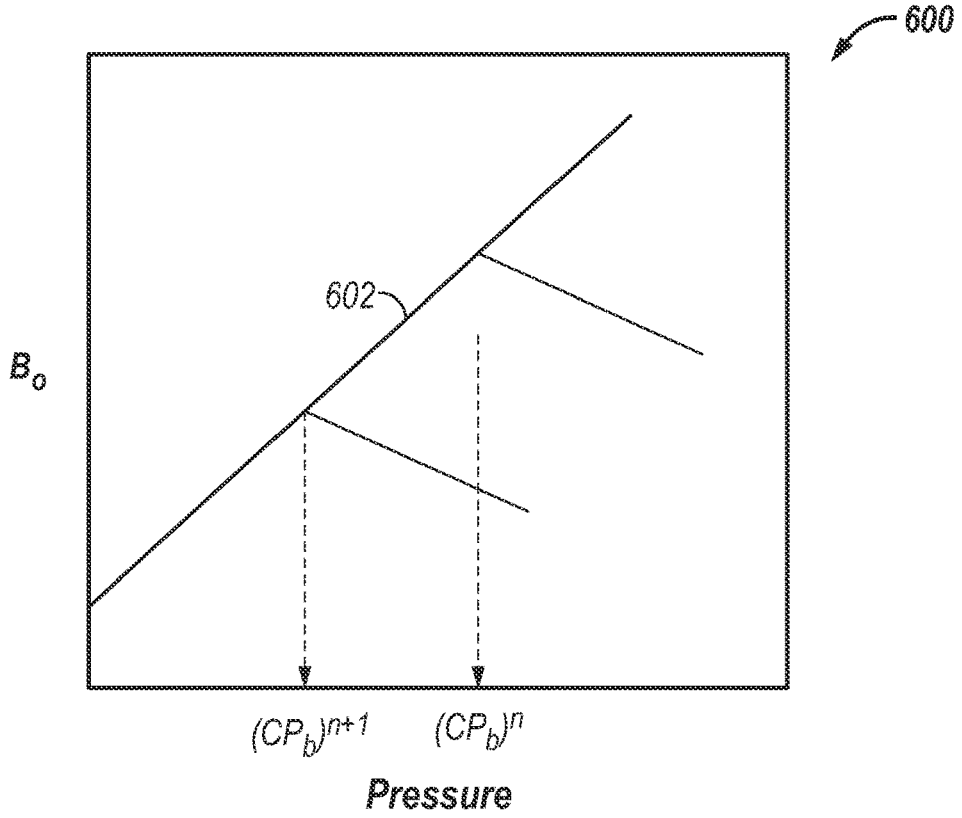
FIG. 6 is a graph of oil formation volume factor ($B_O$) vs cell pressure in accordance with an embodiment of the disclosure.

FIG. 6 is a graph 600 of oil formation volume factor ($B_0$) vs cell pressure in accordance with an embodiment of the disclosure. The saturation line 602 shown in FIG. 6 may be used to extrapolate for the correct $CB_o$ value as a function of CP at a given $CP_b$. Below the $CP_b$ value, $CB_o$ may be evaluated on the line 602. Above $CP_b$, $CB_o$ may be determined according to the Equation discussed infra, as shown by lines 604.

For $CP > CP_b$, both $CB_o$ and $CB_w$ may be determined according to the following:

$$CB_o = CB_{ob}*[1 - c_{o@CP}*(CP - CP_b)] \tag{40}$$

$$CB_w = CB_{wb}*[1 - c_{w@CP}*(CP - CP_b)] \tag{41}$$

where $CB_{ob}$ and $CB_{wb}$ are oil and water formation volume factors respectively evaluated at $CP_b$, and $c_{o@CP}$ and $c_{w@CP}$ are oil and water compressibility respectively evaluated at CP in units of 1/psia. In some embodiments, $CB_g$ may be determined according to the following:

$$CB_g = 0.005035\frac{z*T}{p} \tag{42}$$

where z is the gas compressibility factor, T is temperature in ° R, and p is pressure in psia.

Figure 7:
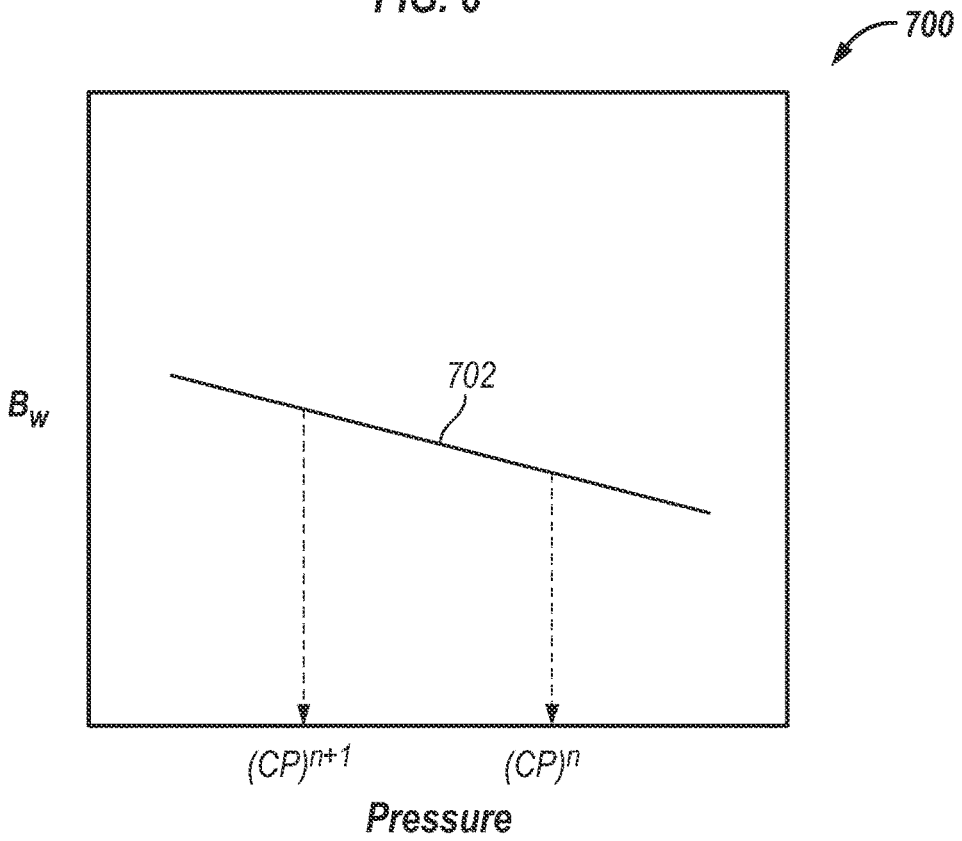
FIG. 7 is a graph of water formation volume factor ($B_w$) vs cell pressure in accordance with an embodiment of the disclosure.

FIG. 7 is a graph 700 of water formation volume factor ($B_w$) vs cell pressure in accordance with an embodiment of the disclosure. The line 702 shown in FIG. 7 represents the water formation volume factors determined according to Equation 41.

Figure 8:
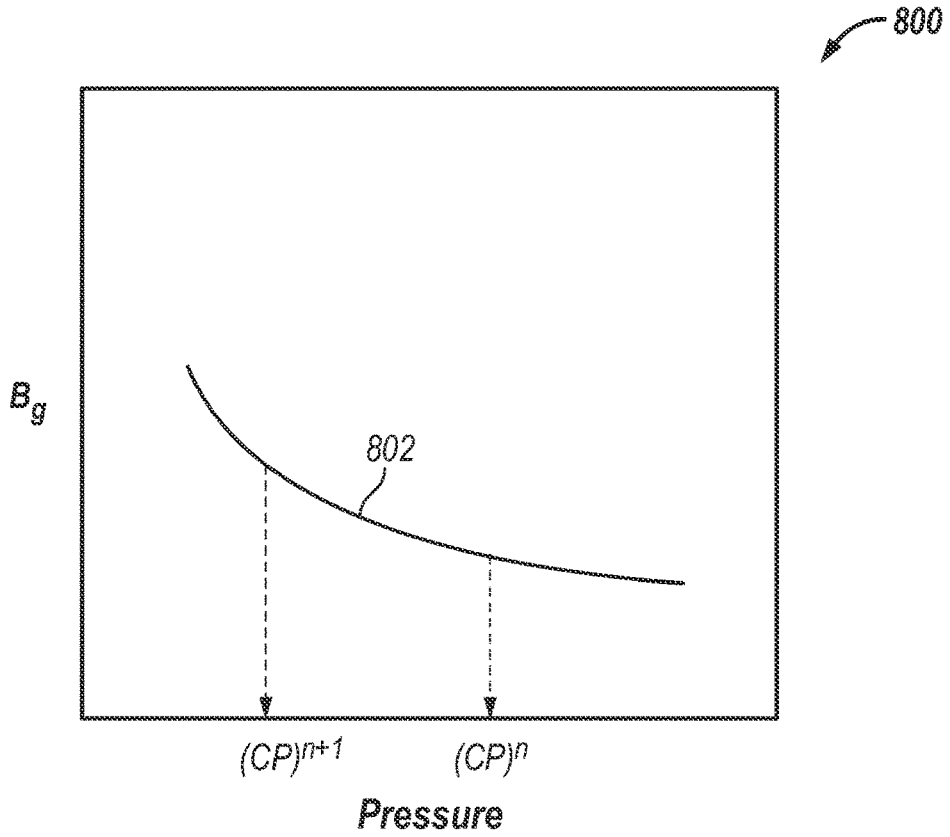
FIG. 8 is a graph of gas formation volume factor ($B_g$) vs cell pressure in accordance with an embodiment of the disclosure.

FIG. 8 is a graph 800 of gas formation volume factor ($B_g$) vs cell pressure in accordance with an embodiment of the disclosure. The line 802 shown in FIG. 8 represents the gas formation volume factors determined according embodiments of the disclosure.

The relationships for oil, water and gas formation volume factors ($CB_o$, $CB_g$ and $CB_w$) and gas solubility ($CR_s$) with regard to cell bubble point pressure and cell pressure may be used to determine accurate properties for the determination of SPL.

Next, the fluid density for oil, gas, and water and for each cell may be determined (block 112). Fluid density in units of pounds per cubic ft ($lb/ft_3$) at reservoir conditions may be determined according to the following:

$$C\rho_o = \frac{62.43}{(CB_o)} * \left(\rho_o^{STD} + \rho_g^{STD} * \frac{(CR_s)}{5.615}\right) \tag{43}$$

$$C\rho_g = \frac{62.43\rho_g^{STD}}{5.615(CB_g)} \tag{44}$$

$$C\rho_w = \frac{62.43\rho_w^{STD}}{(CB_w)} \tag{45}$$

Where $C\rho_o$ is the cell density of oil in units of grams per cubic centimeters (g/cc), Cρg is the cell density of gas in units of g/cc, $C\rho_o$ is the cell density of water in units of g/cc, $\rho_o^{STD}$ is the oil density at standard conditions in units of g/cc, $\rho_g^{STD}$ is the gas density at standard conditions in units of g/cc, $\rho_w^{STD}$ is water density at standard conditions in unit of g/cc. The other parameters $CR_s$, $CB_o$, $CB_g$, and $CB_w$ may be determined as discussed supra in units of standard cubic foot per stock tank barrel (SCF/STB), barrels per stock tank barrel (bbl/STB), barrels per standard cubic foot (bbl/STB), and bbl/STB, respectively.

The average fluid density in each cell may also be determined (block 114). The average fluid density at reservoir conditions may be determined according to the following:

$$C\rho_{avg}=C\rho_o*(CF_o)^n+C\rho_w*(CF_w)^n+C\rho_g*(CF_g)^n \tag{46}$$

where $C\rho_{avg}$ is in units of $lb/ft^3$.

Next, the average PVT properties for the well are determined (block 116). As PVT properties vary from cell to cell, average values may be determined as weighted by cell fractional flow (CF) and Productivity Index (CPI) according to the following:

$$(WR_s) = \frac{\sum_{i=1}^{n} (CR_s)_i * (CPI)_i * (CF_o)_i^n}{\sum_{i=1}^{n} (CPI)_i * (CF_o)_i^n} \tag{47}$$

$$(WB_o) = \frac{\sum_{i=1}^{n} (CB_o)_i * (CPI)_i * (CF_o)_i^n}{\sum_{i=1}^{m} (CPI)_i * (CF_o)_i^n} \tag{48}$$

$$(WB_g) = \frac{\sum_{i=1}^{n} (CB_g)_i * (CPI)_i * (CF_g)_i^n}{\sum_{i=1}^{n} (CPI)_i * (CF_g)_i^n} \tag{49}$$

$$(WB_w) = \frac{\sum_{i=1}^{n} (CB_w)_i * (CPI)_i * (CF_w)_i^n}{\sum_{i=1}^{n} (CPI)_i * (CF_w)_i^n} \tag{50}$$

where ($WR_s$) is the well average solution gas-oil ratio in SCF/STB, ($WB_o$) is the well average oil formation volume factor in bbl/STB, ($WB_g$) is the well average gas formation volume factor in bbl/SCF, and ($WB_w$) is the well average water formation volume factor in bbl/STB.

The total production rate at reservoir conditions may then be determined (block 118). The total production rate $Q_t$ in units of barrels/day (bbl/d) may be determined according to the following:

$$Q_t=Q_o*(WB_o)+Q_w*(WB_w)+(Q_g-Q_o*(WR_s)*(WB_g) \tag{51}$$

where $Q_o$ is the oil production rate in stock tank barrels per day (STB/d), $Q_w$ is the water production rate in STB/d, and $Q_g$ is the gas production rate in standard cubic foot per day (SCF/d).

The well fractional flows (that is, the well fractional flow of oil, the well fractional flow of water, and the well fractional flow of gas) may then be updated at the determined production rate for the current iteration (block 120):

$$(WF_o)^{n+1}=Q_o*(WB_o)/Q_t \tag{52}$$

$$(WF_w)^{n+1}=Q_w*(WB_w) \tag{53}$$

$$(WF_g)^{n+1}=(Q_g-Q_o*(WR_s)*(WB_g)/Q_t \tag{54}$$

The static bottomhole pressure may then be updated for the current iteration (block 122). In some embodiments, the static bottomhole pressure may be updated using the average densities determined supra, according to the following:

$$(CP)_i^{n+1} = P_{datum} + C\rho_{avg_i} * \frac{(CZ_i - Z_{datum})}{144} \tag{55}$$

where $(CP)_i^{n+1}$ is the cell bottomhole pressure in cell i in psia, $P_{datum}$ is the pressure corrected at datum depth in psia, $CZ_i$ is cell depth in ft, and $Z_{datum}$ is the datum depth in ft.

A convergence determination may be performed to decide whether to perform another iteration of the process 100 (decision block 124). The determination may include a comparison of the well fractional flow and cell pressures between the current and previous iterations, according to the following:

$$Er_o=|(WF_o)^{n+1}-(WF_o)^n| \tag{56}$$

$$Er_w=(WF_w)^{n+1}-(WF_w)^n| \tag{57}$$

$$Er_g=(WF_g)^{n+1}-(WF_g)^n| \tag{58}$$

$$Er_p=(CP)^{n+1}-(CP)^n| \tag{59}$$

where $Er_o$ is the error in $WF_o$ between the previous iteration (n) and the current iteration (n+1) in dimensionless quantities, $Er_w$ is the error in $WF_w$ between the previous iteration (n) and the current iteration (n+1) in dimensionless quantities, $Er_g$ is the error in WF, between the previous iteration (n) and the current iteration (n+1) in dimensionless quantities, and $Er_p$ is the error in CP between the previous iteration (n) and the current iteration (n+1) in psia. As will be appreciated, as $Er_p$ represents an error value per cell, the maximum $Er_p$ in all cells is used and not the average.

If the determined errors are at or below the pre-set tolerances (discussed supra with regard to block 104), the process 100 is determined to be complete. If the determined errors are above the pre-set tolerances, the process 100 may perform another iteration using the well fractional flows $(WF_o)^{n+1}$, $(WF_w)^{n+1}$, and $(WF_g)^{n+1}$, and cell pressures $(CP)^{n+1}$ determined from the current iteration.

After obtaining well fractional flows $(WF_o)^{n+1}$, $(WF_w)^{n+1}$, and $(WF_g)^{n+1}$, subsurface three-phase cell saturations may be obtained using the fractional flow-saturation relationship for each cell (block 128), according to the following:

$$CS_{w_i}=F_w^{-1}(CF_{w_i}) \tag{60}$$

$$CS_{o_i}=F_o^{-1}(CF_{o_i}) \tag{61}$$

$$CS_{g_i}=F_g^{-1}(CF_{g_i}) \tag{62}$$

where $CS_{w_i}$, $CS_{o_i}$, $CS_{g_i}$, are the water, oil and gas saturations in cell i in fraction. The cell fractional flows $CF_{wi}$, $CF_{oi}$, and $CF_{gi}$ may be determined from the well fractional flows using the equations discussed supra. The inverse functions $F_w^{-1}$, $F_o^{-1}$, $F_g^{-1}$ are implicit fractional flow functions with saturations for water, oil and gas respectively and may be determined according to the following:

$$F_w(S_w) = \frac{\lambda_w}{\lambda_t} \tag{63}$$

$$F_o(S_o) = \frac{\lambda_o}{\lambda_t} \tag{64}$$

$$F_g(S_g) = \frac{\lambda_g}{\lambda_t} \tag{65}$$

where $\lambda_w$, $\lambda_o$, and $\lambda_g$ are the water, oil and gas mobilities respectively in units of $cp^{-1}$.

Figure 9:
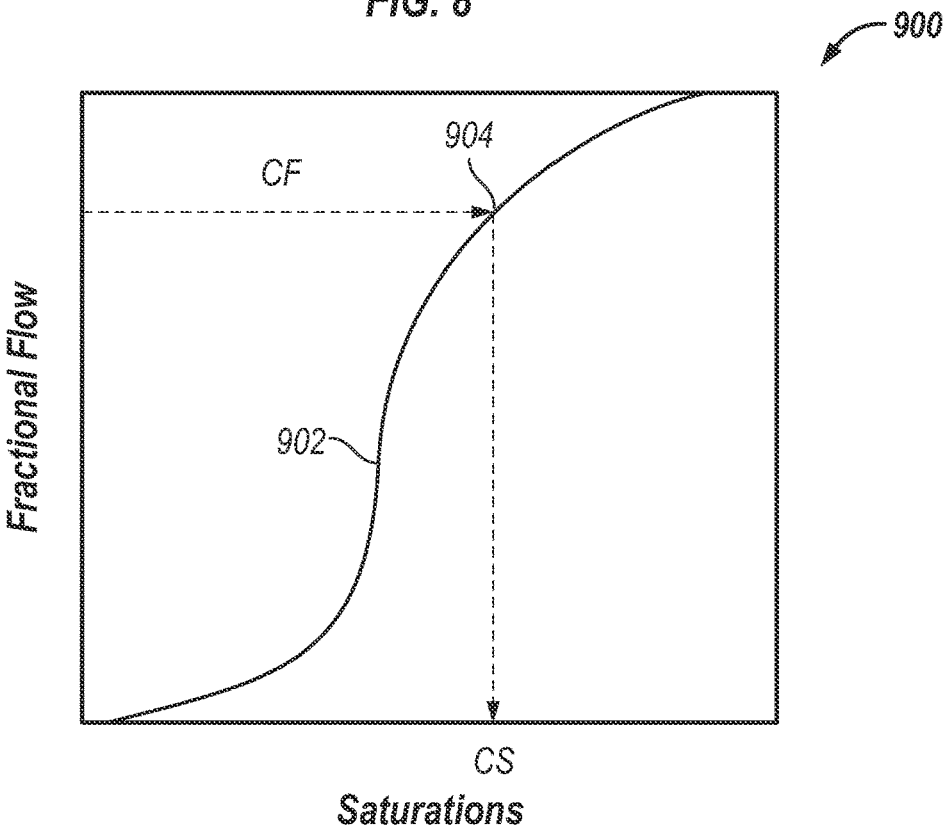
FIG. 9 is a graph of fractional flow vs saturations in accordance with an embodiment of the disclosure.

FIG. 9 depicts a graph 900 of fractional flow vs saturations in accordance with an embodiment of the disclosure. Line 902 illustrates an example of such a relationship that may be used to determine cell saturation (CS) for a given cell fractional flow (CF), as shown by example point 904.

In some embodiments, the cell saturations may be determined from cell fractional flow using the following:

$$CS_{w_i}\approx CF_{w_i}*(1-S_{wc}-S_{orw})+S_{wc} \tag{66}$$

$$CS_{g_i}\approx CF_{g_i}*(1-S_{wc}-S_{org})+S_{gc} \tag{67}$$

$$CS_{o_i}=1-CS_{w_i}-CS_{g_i} \tag{68}$$

where $S_{wc}$ is the irreducible water saturation, $S_{orw}$ is the residual oil saturation to water, $S_{gc}$ is the critical gas saturation, and $S_{org}$ is the residual oil saturation to gas.

In some embodiments, the three-phase saturations (that is, the cell saturations for water, oil, and gas) may be used to identify new drilling sites (block 130), such as potential dry oil regions. In such embodiments, one or more wells may be drilled (for example, for infill drilling) based on the identification using the three-phase saturations.

In some embodiments, the three-phase subsurface saturations (that is, the cell saturations for water, oil, and gas) may be provided to a 4D saturation model. In some embodiments, the 4D saturation model may be as described in U.S. Publication No. 2013/0096896 filed Oct. 18, 2012, and entitled "4D SATURATION MODELING", a copy of which is incorporated by reference in its entirety for the purposes of United States patent practice. In some embodiments, the three-phase subsurface saturations (that is, the cell saturations for water, oil, and gas) may be provided to a 4D saturation model for reservoir modeling, such as the reservoir modeling described in U.S. Publication No. 2013/0096897 filed Oct. 18, 2012, entitled "RESERVOIR MODELING WITH 4D SATURATION MODELS AND SIMULATION MODELS." Advantageously, the three-phase saturation determined according to embodiments of the disclosure may improve the accuracy and qualify of a 4D saturation model and result in improved identification of oil reserves and drilling sites to access such reserves.

Figure 10:
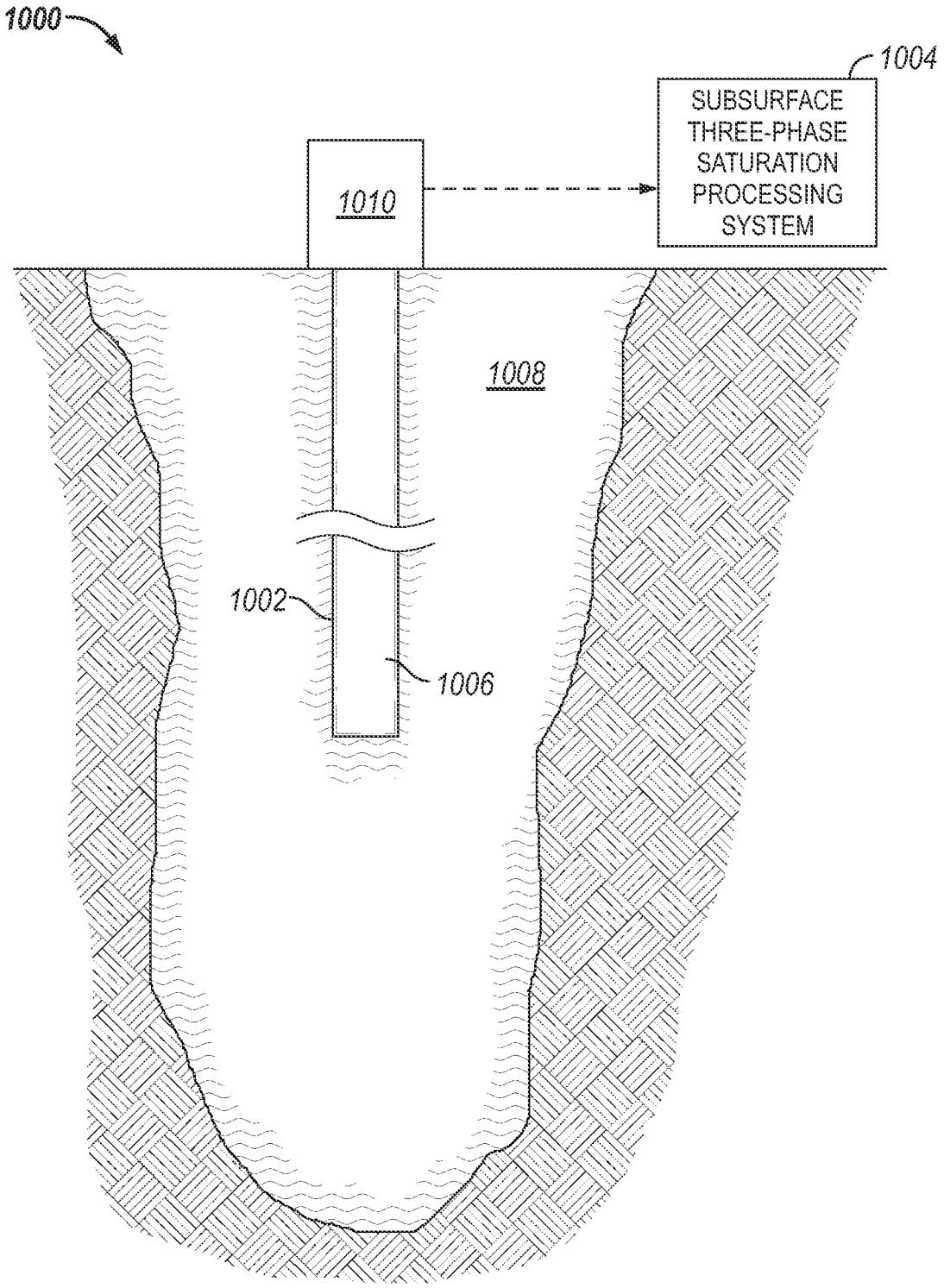
FIG. 10 is diagram of an example well site and a subsurface three-phase saturation processing system in accordance with an embodiment of the disclosure.

FIG. 10 depicts an example well site 1000 having a production well 1002 and a subsurface three-phase saturation processing system 1004 in accordance with an embodiment of the disclosure. The well 1002 includes a wellbore 1006 extending into a formation 1008 having an oil and gas reservoir that provides for the production of oil, gas, and water via the wellbore 1006. In accordance with embodiments of the disclosure, the well 1002 may be a perforated and open completion well. The well 1002 may include casing and other components used in the art to complete the well 1002 for production of fluids. The well site 1000 may include wellhead 1010 for control of the production of hydrocarbons from the production well 1002 via various functionalities and components known in the art. The subsurface three-phase saturation processing system 1004 may obtain data associated with the production well 1002 and determine subsurface three-phase saturation for the formation in accordance with an embodiment of the disclosure. Although only a single well 1002 is depicted, it should be appreciated that data obtained by the subsurface three-phase saturation processing system 1004 may include other production wells accessing the formation 1008.

Figure 11:
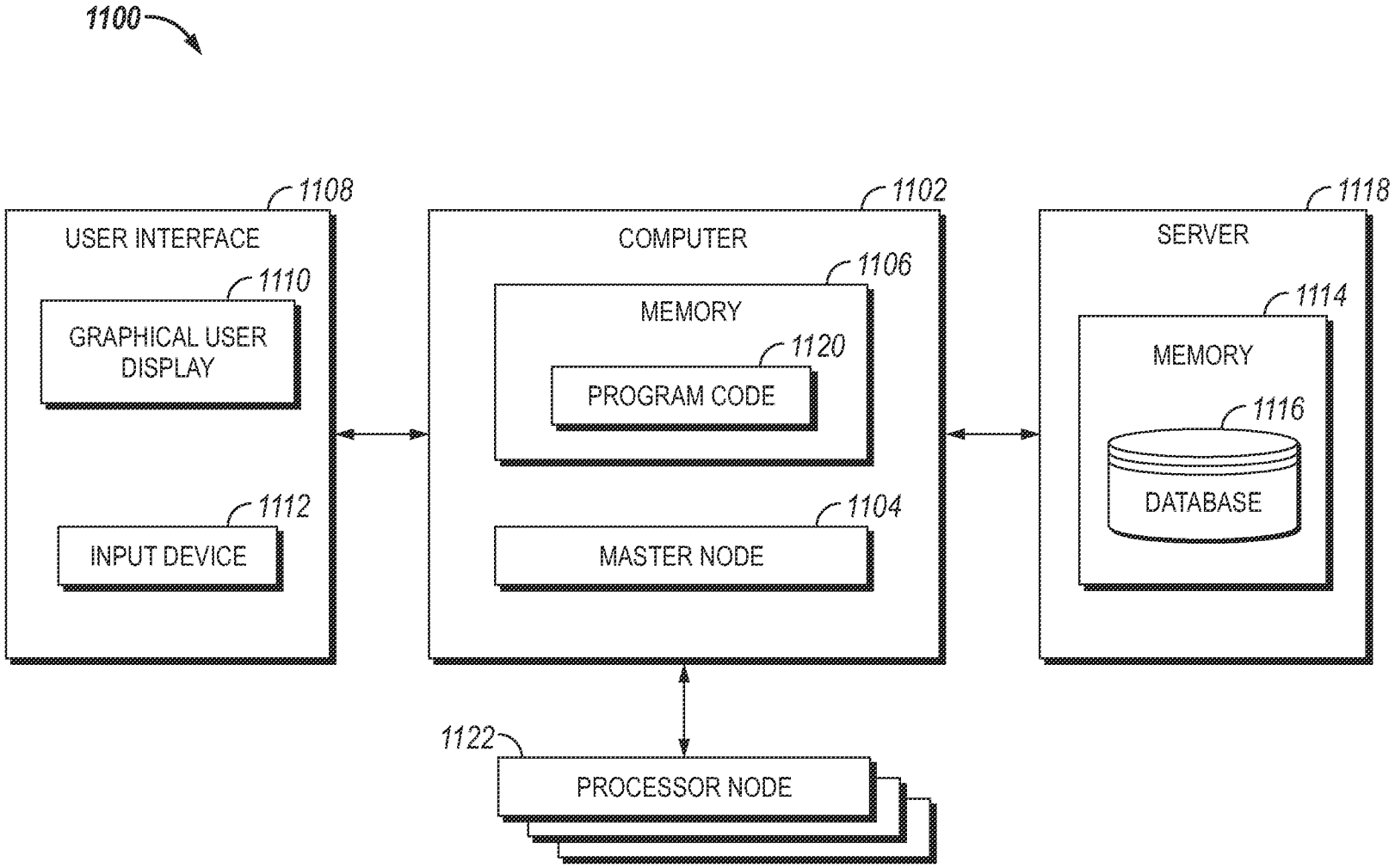
FIG. 11 is a block diagram of a subsurface three-phase saturation processing system in accordance with an embodiment of the disclosure.

FIG. 11 depicts a three-phase saturation processing system 1100 that includes a computer 1102 having a master node processor 1104 and memory 1106 coupled to the processor 1104 to store operating instructions, control information and database records therein. The three-phase saturation processing system 1100 may be a multicore processor with nodes such as those from Intel Corporation or Advanced Micro Devices (AMD), or an HPC Linux cluster computer. The three-phase saturation processing system 1100 may also be a mainframe computer of any conventional type of suitable processing capacity such as those available from International Business Machines (IBM) of Armonk, N.Y. or other source. The three-phase saturation processing system 1100 may in cases also be a computer of any conventional type of suitable processing capacity, such as a personal computer, laptop computer, or any other suitable processing apparatus. It should thus be understood that a number of commercially available data processing systems and types of computers may be used for this purpose The computer 1102 is accessible to operators or users through user interface 1108 and are available for displaying output data or records of processing results obtained according to the present disclosure with an output graphic user display 1110. The output display 1110 includes components such as a printer and an output display screen capable of providing printed output information or visible displays in the form of graphs, data sheets, graphical images, data plots and the like as output records or images.

The user interface 1108 of computer 1102 also includes a suitable user input device or input/output control unit 1112 to provide a user access to control or access information and database records and operate the computer 1102. Three-phase saturation processing system 1100 further includes a database of data stored in computer memory, which may be internal memory 1106, or an external, networked, or non-networked memory as indicated at 1114 in an associated database 1116 in a server 1118.

The three-phase saturation processing system 1100 includes executable code 1120 stored in non-transitory memory 1106 of the computer 1102. The executable code 1120 according to the present disclosure is in the form of computer operable instructions the implement some or all elements of the process 100 and cause the data processor

1104 to determine subsurface three-phase saturations according to the present disclosure.

It should be noted that executable code 1120 may be in the form of microcode, programs, routines, or symbolic computer operable languages capable of providing a specific set of ordered operations controlling the functioning of the three-phase saturation processing system 1100 and direct its operation. The instructions of executable code 1120 may be stored in memory 1106 of the three-phase saturation processing system 1100, or on computer diskette, magnetic tape, conventional hard disk drive, electronic read-only memory, optical storage device, or other appropriate data storage device having a non-transitory computer readable storage medium stored thereon. Executable code 1120 may also be contained on a data storage device such as server 1118 as a non-transitory computer readable storage medium, as shown.

The three-phase saturation processing system 1100 may include a single CPU, or a computer cluster as shown in FIG. 11, including computer memory and other hardware to make it possible to manipulate data and obtain output data from input data. A cluster is a collection of computers, referred to as nodes, connected via a network. Usually a cluster has one or two head nodes or master nodes 1104 used to synchronize the activities of the other nodes, referred to as processing nodes 1122. The processing nodes 1122 each execute the same computer program and work independently on different segments of the grid which represents the reservoir.

Examples

The following example is included to demonstrate embodiments of the disclosure. It should be appreciated by those of skill in the art that the techniques and compositions disclosed in the example which follows represents techniques and compositions discovered to function well in the practice of the disclosure, and thus can be considered to constitute modes for its practice. However, those of skill in the art should, in light of the present disclosure, appreciate that many changes can be made in the specific embodiments which are disclosed and still obtain a like or a similar result without departing from the spirit and scope of the disclosure.

Input data was obtained from an example well to determine a subsurface three-phase saturation. The input data is described in Table 1:

TABLE 1

| INPUT DATA ASSOCIATED WITH EXAMPLE WELL | |
|---|---|
| Oil Production Rate $Q_o$, STB/d | 1408.6 |
| Water Production Rate, $Q_w$, STB/d | 531.2 |
| Gas Production Rate, $Q_g$, SCF/d | 706440 |
| Static Bottomhole Pressure at Datum $P_{datum}$, psia | 2655 |
| Standard Oil Density $\rho_o^{STD}$, g/cc | 0.835 |
| Standard Water Density $\rho_w^{STD}$, g/cc | 1 |
| Standard Gas Density $\rho_g^{STD}$, g/cc | 0.001 |
| Datum Depth, ft | 6000 |

The process 100 described supra was performed. Table 2 describes the resultant total production rate $Q_t$ and well fractional flows WFg, WFo, and WFw:

TABLE 2

| RESULTS ASSOCIATED WITH EXAMPLE WELL | |
|---|---|
| Total Production Rate $Q_t$, bbl/d | 1408.6 |
| Well Fractional Flow for Gas, $WF_g$ | 0.017923 |
| Well Fractional Flow for Oil, $WF_o$ | 0.75453 |
| Well Fractional Flow for Water, $WF_w$ | 0.22755 |

The cell saturations may be determined from the well fractional flows using the techniques described supra.

Additionally, the cell productivity index $CPI_i$, cell bubble point pressure $CPb_i$, weighting factor $w_i$, cell fractional flows for oil ($CF_{oi}$), water ($CF_{wi}$), and gas ($CF_{gi}$), and cell pressures $CR_i$ at different cell datum depths $CZ_i$ are described below in Table 3:

TABLE 3

ADDITIONAL DATA FOR EXAMPLE WELL

| $CZ_i$, ft | $CPI_i$ (Eq. 3), bbl/d/Psia | $CPb_i$ Psia | $w_i$, (Eq. 32) | $CF_{g_i}$ | $CF_{w_i}$ | $CFi_o$ | $CP_i$ |
|---|---|---|---|---|---|---|---|
| 5669.7 | 0.31847 | 2547.4 | 2.77E−06 | 1 | 0 | 0 | 2630.1 |
| 5730.9 | 5.0245 | 2566 | 4.37E−05 | 1 | 0 | 0 | 2634.8 |
| 5822.2 | 26.614 | 2480.9 | 0.000232 | 1 | 0 | 0 | 2641.8 |
| 5886.5 | 11.012 | 2126.1 | 9.58E−05 | 1 | 0 | 0 | 2646.9 |
| 5934.6 | 21559 | 1860.9 | 0.18753 | 0.093631 | 0 | 0.906369 | 2636.4 |
| 5939.7 | 18014 | 1832.7 | 0.1567 | 0 | 0 | 1 | 2636.6 |
| 5944.8 | 12752 | 1804.5 | 0.11093 | 0 | 0 | 1 | 2638.2 |
| 5950 | 21499 | 1776.2 | 0.18701 | 0 | 0 | 1 | 2639.8 |
| 5955.1 | 20249 | 1748 | 0.17613 | 0 | 0.26243 | 0.73757 | 2640.1 |
| 5960.2 | 17025 | 1719.8 | 0.14809 | 0 | 1 | 0 | 2638.5 |
| 5965.3 | 3820.1 | 1691.4 | 0.03323 | 0 | 1 | 0 | 2640.7 |

Ranges may be expressed in the disclosure as from about one particular value, to about another particular value, or both. When such a range is expressed, it is to be understood that another embodiment is from the one particular value, to the other particular value, or both, along with all combinations within said range.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used in the disclosure are for organizational purposes only and are not meant to be used to limit the scope of the description.

What is claimed is:

1. A computer implemented method for determining three-phase saturation of a subsurface reservoir from data measurements of a well in the reservoir during production, the method comprising:

obtaining a surface production rate of oil, a surface production rate of water, and a surface production rate of gas from the well;

obtaining a static bottomhole pressure at a datum depth in the well;

determining a productivity index for each of a plurality of perforated cells associated with the well;

setting an initial well fractional flow, the initial well fractional flow comprising an initial well fractional flow of oil, an initial well fractional flow of gas, and an initial well fractional flow of water;

setting an initial bottomhole pressure for each of the plurality of perforated cells associated with the well;

determining, using the well fractional flow, a cell fractional flow of oil, a cell fractional flow of gas, and a cell fractional flow of water for each of the plurality of perforated cells;

determining, using the static bottomhole pressure, a cell bubble point pressure for each of the plurality of perforated cells;

determining, using the cell bubble point pressure for each of the plurality of perforated cells, a pressure-volume-temperature (PVT) property for each of the plurality of perforated cells;

determining, using the PVT property for each of the plurality of perforated cells, an oil density, a gas density, and a water density for each of the plurality of perforated cells;

determining, using the oil density, the gas density, and the water density for each of the plurality of perforated cells and the cell fractional flow of oil, the cell fractional flow of gas, and the cell fractional flow of water for each of the plurality of perforated cells, an average oil density, an average gas density, and an average water density for each of the plurality of perforated cells;

determining, using the PVT property for each of the plurality of perforated cells and the cell fractional flow of oil, the cell fractional flow of gas, and the cell fractional flow of water for each of the plurality of perforated cells, a PVT property for the well;

determining, using the PVT property for the well, a total production rate for the well at reservoir conditions, the total production rate comprising a total production rate of oil, a total production rate of gas, and a total production rate of water;

determining, using the total production rate for the well and the PVT property for the well, a new well fractional flow of oil, a new well fractional flow of gas, and a new well fractional flow of water;

using the new well fractional flow of oil, the new well fractional flow of gas, and the new well fractional flow of water, to determine the three-phase saturation of the subsurface reservoir, wherein the three-phase saturation comprises an oil saturation, a gas saturation, and a water saturation;

identifying a drilling site using the three-phase saturation; and drilling a well based on the identification.

2. The method of claim 1, wherein the PVT property for each of the plurality of perforated cells comprises a cell oil formation volume factor, a cell gas formation volume factor, a cell water formation volume factor, and a cell solution gas-oil ratio.

3. The method of claim 1, wherein the PVT property for the well comprises a well oil formation volume factor, a well gas formation volume factor, a well water formation volume factor, and a well solution gas-oil ratio.

4. The method of claim 1, comprising;

comparing the new well fractional flow of oil to the initial well fractional of oil to determine an oil error value;

comparing the oil error value to a first threshold;

comparing the new well fractional flow of gas to the initial well fractional of gas to determine a gas error value;

comparing the gas error value to a second threshold;

comparing the new well fractional flow of water to the initial well fractional of water to determine a water error value; and comparing the water error value to a third threshold.

5. The method of claim 1, comprising determining a new static bottomhole pressure for each of the plurality of perforated cells using the average oil density, the average gas density, and the average water density for each of the plurality of perforated cells.

6. The method of claim 5, comprising:

comparing the new static bottomhole pressure for each of the plurality of perforated cells to the initial bottomhole pressure for each of the plurality of perforated cells to determine a pressure value; and comparing the pressure value to a third threshold.

7. A non-transitory computer-readable storage medium having executable code stored thereon for determining three-phase saturation of a subsurface reservoir from data measurements of a well in the reservoir during production, the executable code comprising a set of instructions that causes a processor to perform operations comprising:

obtaining a surface production rate of oil, a surface production rate of water, and a surface production rate of gas from the well;

obtaining a static bottomhole pressure at a datum depth in the well;

determining a productivity index for each of a plurality of perforated cells associated with the well;

setting an initial well fractional flow, the initial well fractional flow comprising an initial well fractional flow of oil, an initial well fractional flow of gas, and an initial well fractional flow of water;

setting an initial bottomhole pressure for each of the plurality of perforated cells associated with the well;

determining, using the well fractional flow, a cell fractional flow of oil, a cell fractional flow of gas, and a cell fractional flow of water for each of the plurality of perforated cells;

determining, using the static bottomhole pressure, a cell bubble point pressure for each of the plurality of perforated cells;

determining, using the cell bubble point pressure for each of the plurality of perforated cells, a pressure-volume-temperature (PVT) property for each of the plurality of perforated cells;

determining, using the PVT property for each of the plurality of perforated cells, an oil density, a gas density, and a water density for each of the plurality of perforated cells;

determining, using the oil density, the gas density, and the water density for each of the plurality of perforated cells and the cell fractional flow of oil, the cell fractional flow of gas, and the cell fractional flow of water for each of the plurality of perforated cells, an average oil density, an average gas density, and an average water density for each of the plurality of perforated cells;

determining, using the PVT property for each of the plurality of perforated cells and the cell fractional flow of oil, the cell fractional flow of gas, and the cell fractional flow of water for each of the plurality of perforated cells, a PVT property for the well;

determining, using the PVT property for the well, a total production rate for the well at reservoir conditions, the total production rate comprising a total production rate of oil, a total production rate of gas, and a total production rate of water;

determining, using the total production rate for the well and the PVT property for the well, a new well fractional flow of oil, a new well fractional flow of gas, and a new well fractional flow of water;

using the new well fractional flow of oil, the new well fractional flow of gas, and the new well fractional flow of water, to determine the three-phase saturation of the subsurface reservoir, wherein the three-phase saturation comprises an oil saturation, a gas saturation, and a water saturation;

identifying a drilling site using the three-phase saturation; and drilling a well based on the identification.

8. The non-transitory computer-readable storage medium of claim 7, wherein the PVT property for each of the plurality of perforated cells comprises a cell oil formation volume factor, a cell gas formation volume factor, a cell water formation volume factor, and a cell solution gas-oil ratio.

9. The non-transitory computer-readable storage medium of claim 7, wherein the PVT property for the well comprises a well oil formation volume factor, a well gas formation volume factor, a well water formation volume factor, and a well solution gas-oil ratio.

10. The non-transitory computer-readable storage medium of claim 7, the operations comprising;

comparing the new well fractional flow of oil to the initial well fractional of oil to determine an oil error value;

comparing the oil error value to a first threshold;

comparing the new well fractional flow of gas to the initial well fractional of gas to determine a gas error value;

comparing the gas error value to a second threshold;

comparing the new well fractional flow of water to the initial well fractional of water to determine a water error value; and comparing the water error value to a third threshold.

11. The non-transitory computer-readable storage medium of claim 7, the operations comprising determining a new static bottomhole pressure for each of the plurality of perforated cells using the average oil density, the average gas density, and the average water density for each of the plurality of perforated cells.

12. The non-transitory computer-readable storage medium of claim 11, the operations comprising:

comparing the new static bottomhole pressure for each of the plurality of perforated cells to the initial bottomhole pressure for each of the plurality of perforated cells to determine a pressure value; and comparing the pressure error value to a third threshold.

13. A system for determining three-phase saturation of a subsurface reservoir from data measurements of a well in the reservoir during production, comprising:

a processor;

a non-transitory computer-readable memory accessible by the processor and having executable code stored thereon, the executable code comprising a set of instructions that causes the processor to perform operations comprising:

obtaining a surface production rate of oil, a surface production rate of water, and a surface production rate of gas from the well;

obtaining a static bottomhole pressure at a datum depth in the well;

determining a productivity index for each of a plurality of perforated cells associated with the well;

setting an initial well fractional flow, the initial well fractional flow comprising an initial well fractional flow of oil, an initial well fractional flow of gas, and an initial well fractional flow of water;

setting an initial bottomhole pressure for each of the plurality of perforated cells associated with the well;

determining, using the well fractional flow, a cell fractional flow of oil, a cell fractional flow of gas, and a cell fractional flow of water for each of the plurality of perforated cells;

determining, using the static bottomhole pressure, a cell bubble point pressure for each of the plurality of perforated cells;

determining, using the cell bubble point pressure for each of the plurality of perforated cells, a pressure-volume-temperature (PVT) property for each of the plurality of perforated cells;

determining, using the PVT property for each of the plurality of perforated cells, an oil density, a gas density, and a water density for each of the plurality of perforated cells;

determining, using the oil density, the gas density, and the water density for each of the plurality of perforated cells and the cell fractional flow of oil, the cell fractional flow of gas, and the cell fractional flow of water for each of the plurality of perforated cells, an average oil density, an average gas density, and an average water density for each of the plurality of perforated cells;

determining, using the PVT property for each of the plurality of perforated cells and the cell fractional flow of oil, the cell fractional flow of gas, and the cell fractional flow of water for each of the plurality of perforated cells, a PVT property for the well;

determining, using the PVT property for the well, a total production rate for the well at reservoir conditions, the total production rate comprising a total production rate of oil, a total production rate of gas, and a total production rate of water;

determining, using the total production rate for the well and the PVT property for the well, a new well fractional flow of oil, a new well fractional flow of gas, and a new well fractional flow of water; and using the new well fractional flow of oil, the new well fractional flow of gas, and the new well fractional flow of water, to determine the three-phase saturation of the subsurface reservoir, wherein the three-phase saturation comprises an oil saturation, a gas saturation, and a water saturation;

identifying a drilling site using the three-phase saturation; and drilling a well based on the identification.

14. The system of claim 13, wherein the PVT property for each of the plurality of perforated cells comprises a cell oil formation volume factor, a cell gas formation volume factor, a cell water formation volume factor, and a cell solution gas-oil ratio.

15. The system of claim 13, wherein the PVT property for the well comprises a well oil formation volume factor, a well gas formation volume factor, a well water formation volume factor, and a well solution gas-oil ratio.

16. The system of claim 13, the operations comprising;

comparing the new well fractional flow of oil to the initial well fractional of oil to determine an oil error value;

comparing the oil error value to a first threshold;

comparing the new well fractional flow of gas to the initial well fractional of gas to determine a gas error value;

comparing the gas error value to a second threshold;

comparing the new well fractional flow of water to the initial well fractional of water to determine a water error value; and comparing the water error value to a third threshold.

17. The system of claim 13, the operations comprising determining a new static bottomhole pressure for each of the plurality of perforated cells using the average oil density, the average gas density, and the average water density for each of the plurality of perforated cells.

18. The system of claim 17, the operations comprising:

comparing the new static bottomhole pressure for each of the plurality of perforated cells to the initial bottomhole pressure for each of the plurality of perforated cells to determine a pressure value; and comparing the pressure value to a third threshold.

* * * * *